United States Patent [19]

Chambers

[11] Patent Number: 5,070,553

[45] Date of Patent: Dec. 10, 1991

[54] SHOWER HEAD ASSEMBLY

[76] Inventor: Keith A. Chambers, P.O. Box 100681, Ft. Lauderdale, Fla. 33310-0681

[21] Appl. No.: 619,596

[22] Filed: Nov. 29, 1990

[51] Int. Cl.[5] ..... A47K 3/22; B05B 1/00

[52] U.S. Cl. ..... 4/615; 239/391; 239/390; 4/605; 4/597

[58] Field of Search ..... 4/615, 597, 605; 239/390, 391, 575, 590, 587

[56] References Cited

U.S. PATENT DOCUMENTS

| | | | |
|---|---|---|---|
| 2,395,227 | 2/1946 | Lewis et al. | 239/575 |
| 3,685,745 | 8/1972 | Peschcke-Koedt | 239/587 |
| 3,917,172 | 11/1975 | O'Hare | 239/575 |
| 4,035,004 | 7/1977 | Hengesbach | 239/587 |
| 4,242,201 | 12/1980 | Stephens et al. | 4/605 |
| 4,311,279 | 1/1982 | Jette | 239/587 |
| 4,674,687 | 6/1987 | Smith et al. | 239/587 |
| 4,790,481 | 12/1988 | Ray et al. | 239/590 |
| 4,793,331 | 12/1988 | Stewart | 4/615 |
| 4,863,103 | 9/1989 | Gannaway | 239/590 |
| 4,901,927 | 2/1990 | Valdivia | 4/615 |
| 4,903,687 | 2/1990 | Lih-Sheng | 4/615 |
| 4,933,080 | 6/1990 | Rundzaitis et al. | 4/605 |

*Primary Examiner*—William A. Cuchlinski, Jr.
*Assistant Examiner*—Diego F. F. Gutierrez
*Attorney, Agent, or Firm*—Leon Gilden

[57] ABSTRACT

A shower head assembly includes a housing with a filtration matrix therewithin, typically of a charcoal-type filtration medium, and wherein the housing includes a lower end threadedly receiving a shower head, with an upper end threadedly receiving a conduit; a pivot connection mounted to the conduit, as well as the use of a cup-shaped connection member with a cylindrical resilient seal to mount the assembly to an existing shower head; a flexible hose in fluid communication with the lower end of the housing at one end and with a rigid tube at the other end, the rigid tube including a rigid tube sleeve surroundingly mounted around the rigid tube and with a valve to selectively control fluid flow through the rigid tube; and wherein the rigid tube sleeve has a first hook and loop fastener strip cooperative with a second hook and loop fastener strip provided in the housing in order to secure the rigid tube sleeve to the second housing.

1 Claim, 5 Drawing Sheets

25
20
21a
28
17
19
11
15a
31
18
14
13
29
30
32
27

26
25
19a
20
19
15a

SHOWER HEAD ASSEMBLY

BACKGROUND OF THE INVENTION

1. Field of the Invention

The field of invention relates to shower head organizations, and more particularly pertains to a new and improved shower head assembly wherein the same provides a filtration organization readily mounted to existing plumbing.

2. Description of the Prior Art

Various shower head assemblies have been utilized in the prior art, and particularly for filtration purposes. Such patents are exemplified by U.S. Pat. No. 4,740,296 to Roman wherein a water filter member mounted to existing plumbing includes a stacked filtration organization.

U.S. Pat. No. 4,556,484 to Hunter, et al. sets forth a water filter organization structure set forth as a canister member mounted to plumbing for filtration of water.

U.S. Pat. No. 4,221,335 to Shames, et al. sets forth a flow controller limiting maximum water flow through a domestic flow appliance, such as a shower head.

U.S. Pat. No. 4,828,694 to Leason sets forth a filter member utilized in a flow system wherein water is forced through the filter by a suction source connected to the filter outlet.

U.S. Pat. No. 4,244,526 to Arth sets forth a controlled flow shower head utilizing a basic screen filter member.

As such, it may be appreciated that there continues to be a need for a new and improved shower head assembly as set forth by the instant invention which addresses both the problems of ease of use as well as effectiveness in construction in filtration and mounting of the organization to existing plumbing and in this respect, the present invention substantially fulfills this need.

SUMMARY OF THE INVENTION

In view of the foregoing disadvantages inherent in the known types of shower head apparatus now present in the prior art, the present invention provides a shower head assembly wherein the same provides an organization to effect filtration and ease of mounting of the organization to existing plumbing structure. As such, the general purpose of the present invention, which will be described subsequently in greater detail, is to provide a new and improved shower head assembly which has all the advantages of the prior art shower head apparatus and none of the disadvantages.

To attain this, the present invention provides an apparatus wherein a shower head includes a housing, with a filtration matrix therewithin, typically of a charcoal-type filtration medium, wherein the housing includes a lower end threadedly receiving a shower head, with an upper end threadedly receiving a conduit. A modification of the invention includes a pivot connection mounted to the conduit, as well as the use of a connection member to mount the organization to an existing shower head assembly.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved shower head assembly which has all the advantages of the prior art shower head apparatus and none of the disadvantages.

It is another object of the present invention to provide a new and improved shower head assembly which may be easily and efficiently manufactured and marketed.

It is a further object of the present invention to provide a new and improved shower head assembly which is of a durable and reliable construction.

An even further object of the present invention is to provide a new and improved shower head assembly which is susceptible of a low cost of manufacture with regard to both materials and labor, and which accordingly is then susceptible of low prices of sale to the consuming public, thereby making such shower head assemblies economically available to the buying public.

Still yet another object of the present invention is to provide a new and improved shower head assembly which provides in the apparatuses and methods of the prior art some of the advantages thereof, while simultaneously overcoming some of the disadvantages normally associated therewith.

Still another object of the present invention is to provide a new and improved shower head assembly wherein the same utilizes convenience in mounting of the organization to existing plumbing to effect filtration of fluid therethrough.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
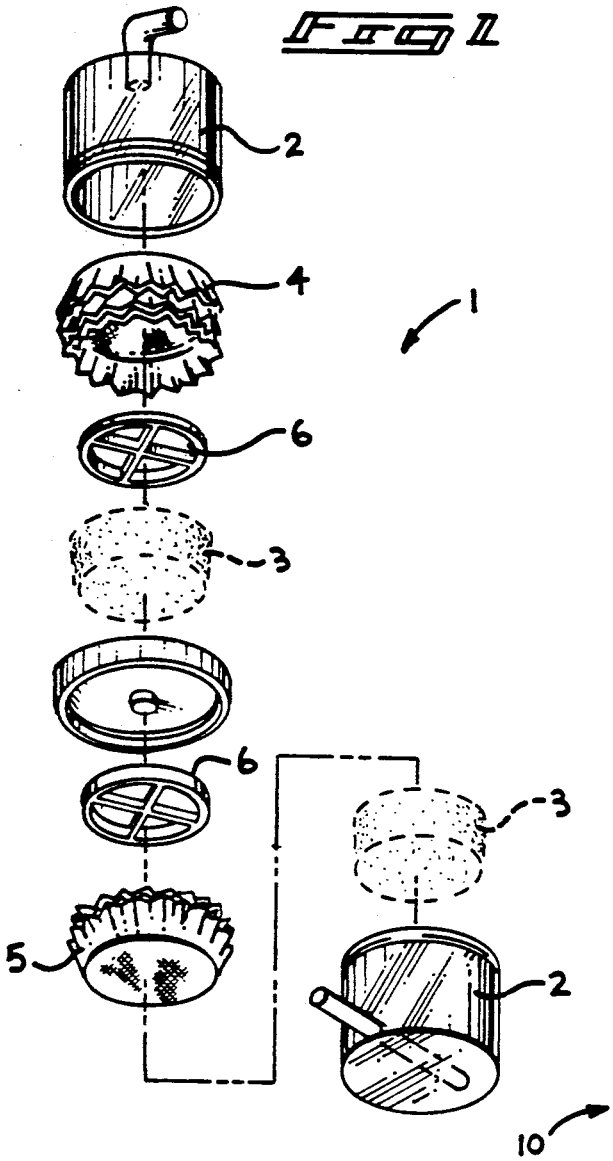
FIG. 1 is an isometric exploded illustration of a prior art shower head assembly.
Figure 2:
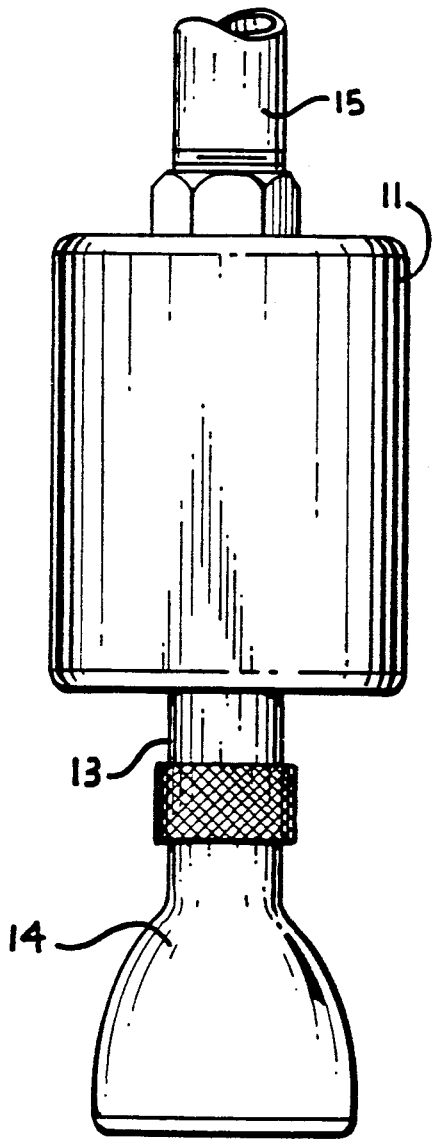
FIG. 2 is an orthographic side view, taken in elevation, of the instant invention.
Figure 3:
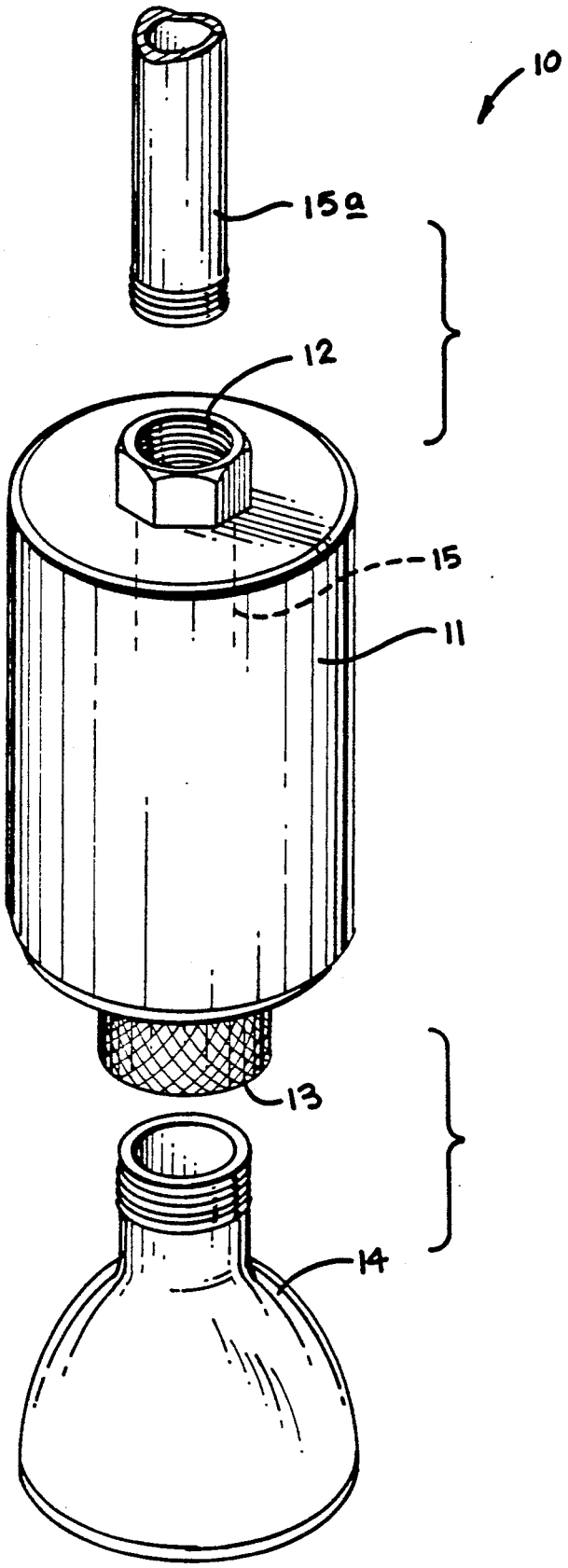
FIG. 3 is an isometric illustration, somewhat exploded, of the instant invention.

With reference now to the drawings, and in particular to FIGS. 1 to 9 thereof, a new and improved shower head assembly embodying the principles and concepts of the present invention and generally designated by the reference numerals 10, 10*a*, and 10*b* will be described.

FIG. 1 illustrates a prior art shower head assembly 1, wherein an upper and lower housing 2 are assembled that include filtration components 3, as well as fabric filter members 4 and 5 positioned at an upper and lower spaced relationship utilizing spacers and the like for positioning the various filter elements within the housing, in a manner as set forth in U.S. Pat. No. 4,740,296.

More specifically, the shower head assembly 10 of the instant invention essentially comprises an elongate coaxially aligned housing 11 containing a filtration medium throughout the internal cavity, with an inlet conduit 15 directing fluid into the internal cavity. Typically, the medium is of a charcoal-type material. An internally threaded inlet 12 permits connection of the housing 11 to an upper inlet conduit 15*a*. An internally threaded outlet conduit 13 provides securement to a shower head 14.

Figure 4:
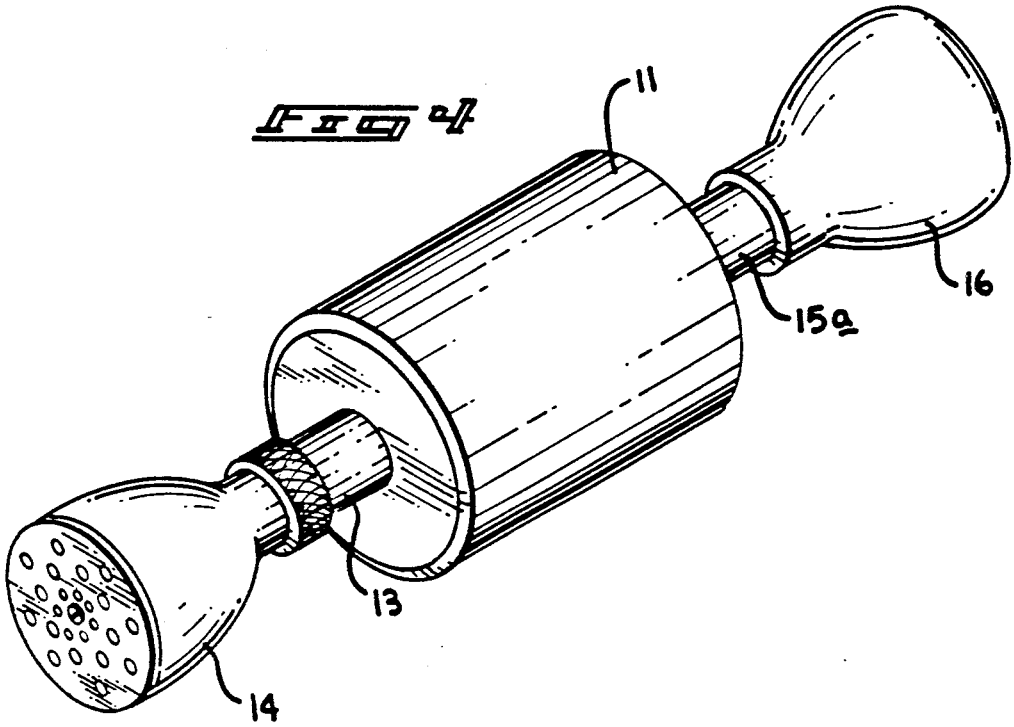
FIG. 4 is an isometric illustration of a modification of the instant invention.
Figure 5:
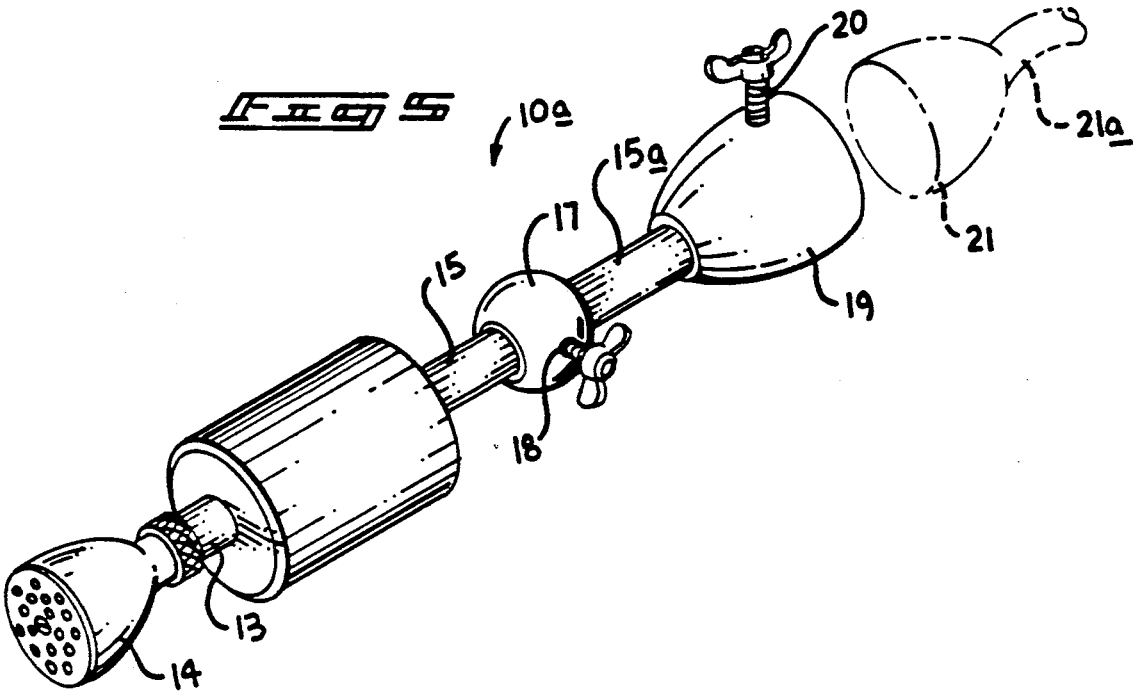
FIG. 5 is an isometric illustration of a further modification of the instant invention.
Figure 6:
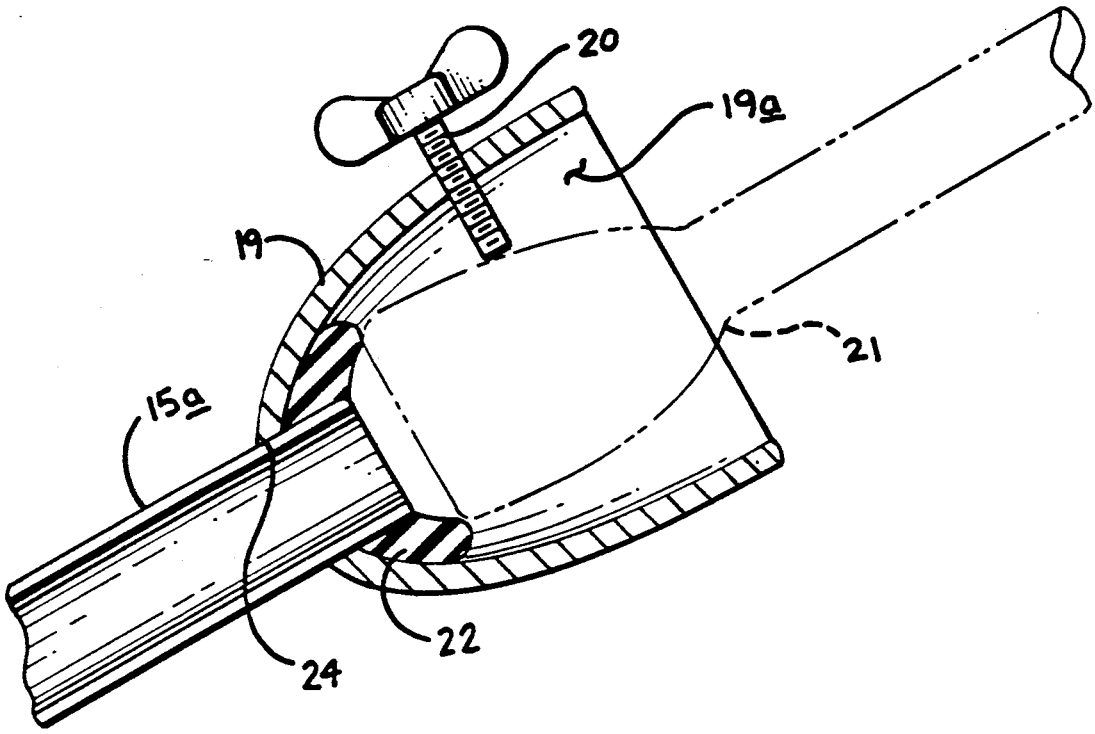
FIG. 6 is a cross-sectional illustration setting forth internal structure of the connector member, as illustrated in FIG. 5.
Figure 7:
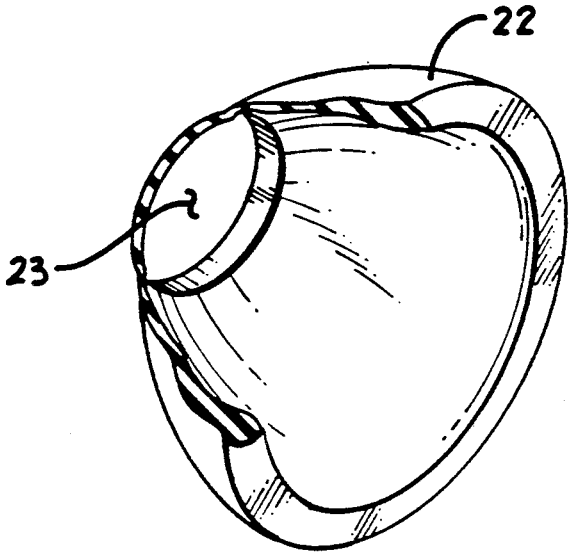
FIG. 7 is an isometric illustration of the conical seal utilized by the connector member of the instant invention.

FIG. 4 illustrates the housing 11 and the upper inlet conduit 15 mounted to a resilient expandable memory retentent cup member 16 to permit securement of the cup member 16 to an existing shower head 21 in a sealing relationship. Alternatively, with reference to FIG. 5, the modification 10*a* sets forth the use of a pivot connection 17 mounted in alignment within the inlet conduit 15 to divide the inlet conduit into an upper inlet conduit positioned between the pivot connection and the housing and a second inlet conduit to permit pivotment of the conduit, with a remote terminal end (or free terminal end) of the inlet conduit 15*a* including a rigid cup-shaped connector member 19 mounted thereto through an exit opening. A first detent screw 18 provides frictional retention of the spaced upper inlet conduits 15*a* on each side of the pivot connection 17. A second detent screw 20 that is directed orthogonally relative to an axis defined by the cup-shaped connector 19 provides securement of the cup-shaped connector member 19 to an existing shower head 21 that in turn is mounted to an existing supply conduit 21*a* . Reference to FIGS. 6 and 7 illustrate the use of a hollow conical seal member 22 defining an exterior surface complementary to the interior cavity 19*a*of the cup-shaped connector 19. The hollow conical seal 22 defines an axial height less than that defined by the cup-shaped connector 19 to permit a sealing reception of an existing shower head 21 and securement thereto by the second detent screw 20.

Figure 8:
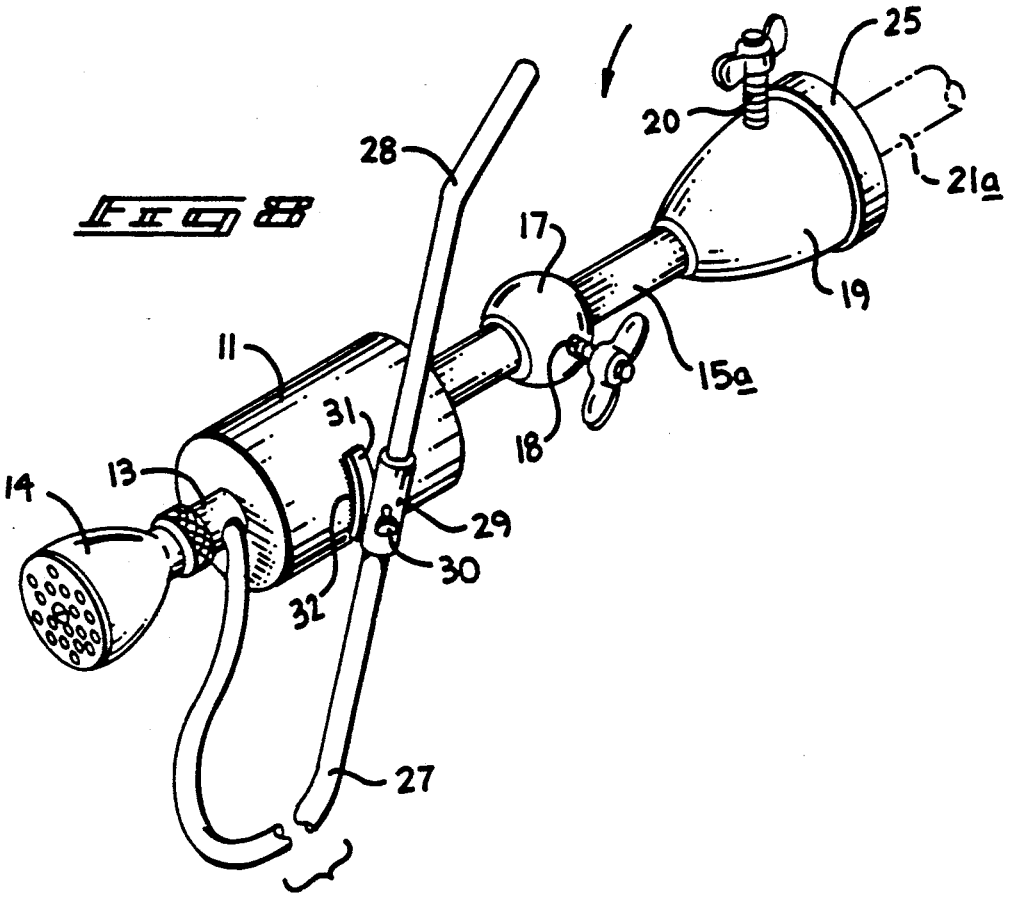
FIG. 8 is an isometric illustration of a further embodiment of the instant invention.
Figure 9:
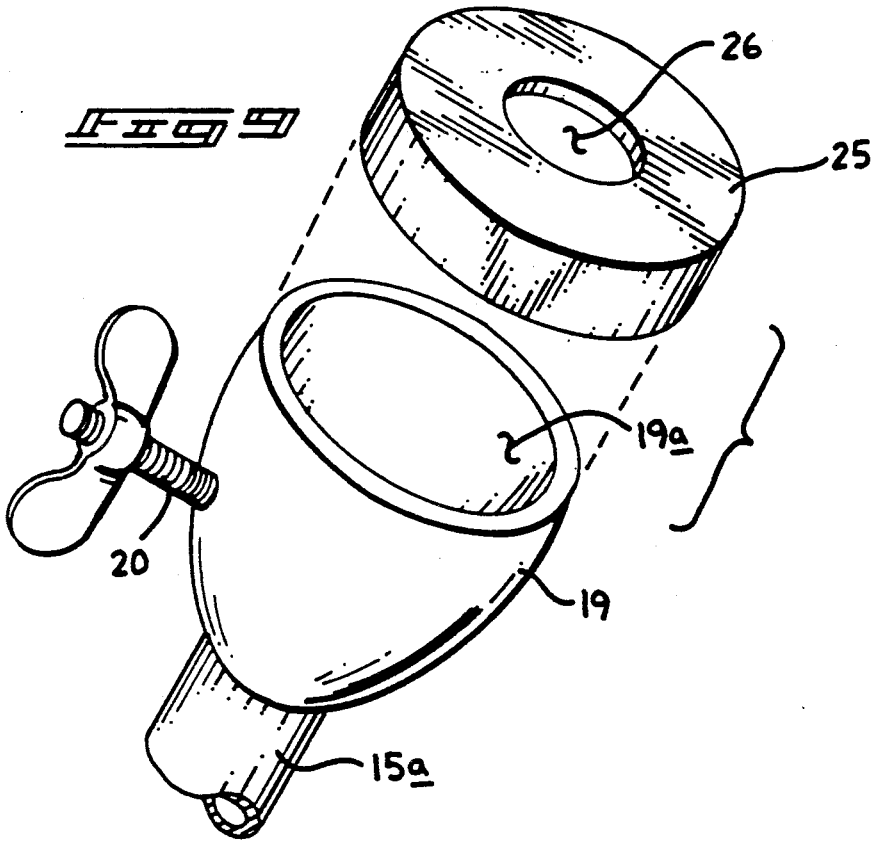
FIG. 9 is an isometric illustration, somewhat exploded, of the cylindrical seal utilized by the instant invention as set forth in FIG. 8.

FIG. 8 sets forth the further use of a cylindrical resilient seal 25 defined as a splash guard that includes an axially directed opening 26 defining a diameter substantially equal to an external diameter defined by the supply conduit 21*a*. The seal 25 further includes a cylindrical skirt defining a predetermined diameter substantially equal to an external diameter defined by the cup-shaped connector member 19 at its entrance opening to the cavity 19*a*. Further, a flexible hose 27 is mounted to the outlet conduit 13 and a rigid tube 28 is mounted to the hose 27 and spaced from the outlet conduit to be utilized in a dental cleaning operation with a valve 30 to selectively direct fluid flow through the flexible hose 27 from the outlet conduit 13 to the rigid tube 28 by way of the valve 30. Further, the rigid tube 28 includes a rigid tube sleeve 29 with the valve 30 directed therethrough, with a first hook and loop fastener strip 31 mounted thereon cooperative with a second hook and loop fastener strip 32 mounted to the housing 11.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A shower head assembly comprising, a housing, the housing including a filtration medium contained therewithin, with the housing including an inlet conduit directed into an upper end of the housing and an outlet conduit directed from a lower end of the housing, with the outlet conduit including a shower head member secured thereto, and wherein the inlet conduit includes a pivot connection dividing the inlet conduit into first upper inlet conduit positioned between the pivot connection and the housing, and a second inlet conduit positioned in fluid communication with the first inlet conduit spaced therefrom, and a first detent screw directed through the pivot connection to provide a predetermined angular orientation of the first inlet conduit to the second inlet conduit, and wherein the second inlet conduit includes a free terminal end spaced from the pivot connection and a rigid cup-shaped connector member mounted at the free terminal end, with said rigid cup-shaped connector member including a rear exit opening secured to and in coaxial alignment with the free terminal end of the second inlet conduit, the connector member defining an interior cavity between an entrance opening coaxially aligned with and spaced relative to the exit opening, and a second detent screw orthogonally oriented relative to an axis defined by the connector member to secure an existing shower head within said interior cavity, and wherein the cup-shaped connector member further includes a cylindrical resilient seal mounted overlying and receiving the entrance opening of the cup-shaped connector, and the cylindrical resilient seal including an axial opening to surroundingly receive a supply conduit mounted to the existing shower head that is secured within the interior cavity, and wherein the interior cavity includes a conical seal, the conical seal defining an exterior surface complementary to an interior surface of the cup-shaped member, and the conical seal including a conical seal opening coaxially aligned with and in contiguous communication with the rear exit opening of the connector member, and including a flexible hose in fluid communication with the outlet conduit, the flexible hose secured to a rigid tube mounted to the flexible hose spaced from the outlet conduit, and the rigid tube including a rigid tube sleeve surroundingly mounted about the rigid tube, the rigid tube sleeve including a valve directed therethrough to selectively control fluid flow through the rigid tube, and the rigid tube sleeve further including a first hook and loop fastener strip, and the housing including a second hook and loop fastener strip cooperative with the first hook and loop fastener strip to secure the rigid tube sleeve to the housing.

* * * * *